US008206236B1

(12) United States Patent
Neu

(10) Patent No.: US 8,206,236 B1
(45) Date of Patent: Jun. 26, 2012

(54) GOLF TOOL RETENTION CLIP

(76) Inventor: Kenneth Neu, Fort Myers, FL (US)

( * ) Notice: Subject to any disclaimer, the term of this patent is extended or adjusted under 35 U.S.C. 154(b) by 192 days.

(21) Appl. No.: 12/592,394

(22) Filed: Nov. 23, 2009

Related U.S. Application Data

(63) Continuation-in-part of application No. 12/157,693, filed on Jun. 12, 2008, now Pat. No. 7,621,819, which is a continuation-in-part of application No. 11/825,810, filed on Jul. 9, 2007, now Pat. No. 7,527,563.

(51) Int. Cl.
*A63B 57/00* (2006.01)
*A63B 55/10* (2006.01)

(52) U.S. Cl. ..... 473/282; 473/408; 24/3.12; 81/460; 248/156; 172/375; 172/378

(58) Field of Classification Search ..... 473/406, 473/408, 286, 285, 282; 24/3.12; 81/460; 248/156; 172/375, 378
See application file for complete search history.

(56) References Cited

U.S. PATENT DOCUMENTS 3,620,426 A * 11/1971 Hatch ..... 224/268
4,129,237 A * 12/1978 Grinder ..... 224/669
4,406,040 A * 9/1983 Cannone ..... 24/3.12
4,627,621 A * 12/1986 Tate ..... 473/286
5,829,103 A * 11/1998 Allen ..... 24/11 R
5,867,874 A * 2/1999 Simpson ..... 24/336
6,033,322 A * 3/2000 England ..... 473/408
6,477,744 B1 * 11/2002 Miles ..... 24/3.12
7,766,769 B2 * 8/2010 Lueders ..... 473/408
2001/0016526 A1 * 8/2001 Tate ..... 473/406
2002/0034992 A1 * 3/2002 Tate ..... 473/406
2006/0247075 A1 * 11/2006 Dymling ..... 473/408
2008/0102989 A1 * 5/2008 Gonzalez et al. ..... 473/406
2008/0230435 A1 * 9/2008 Cope ..... 206/579
2009/0163300 A1 * 6/2009 Lueders ..... 473/408
2011/0009214 A1 * 1/2011 Steinberg ..... 473/406

* cited by examiner

*Primary Examiner* — Stephen L. Blau

(57) ABSTRACT

A golf tool retention clip attaches to a brim of a hat and retains the golf tool where the wearer of the hat has ready and easy access to the golf tool during play of the game of golf. The golf tool retention clip also retains a ball marker for ready and easy access to the ball marker during play of the game of golf. The golf tool retention clip is inconspicuous to the player and does not interfere with play of the game of golf. The golf tool retention clip has opposing panels with are coupled together and which side onto the brim of the hat with the golf tool positioned on the upper surface of the brim while the ball marker positioned on the lower surface of the brim. The golf tool has features to perform multiple functions associated with the game of golf.

16 Claims, 10 Drawing Sheets

40

170
20

40
20

150
166
178
174
148
172
176
164
168
142
20

150
160
152
156
162
154
146
158
140
20

144
142
140
20

144
142
140
20

170

28
24
22
38
36
26
34
40

FIG. 13
'Prior Art'
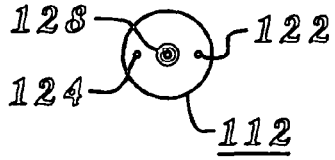
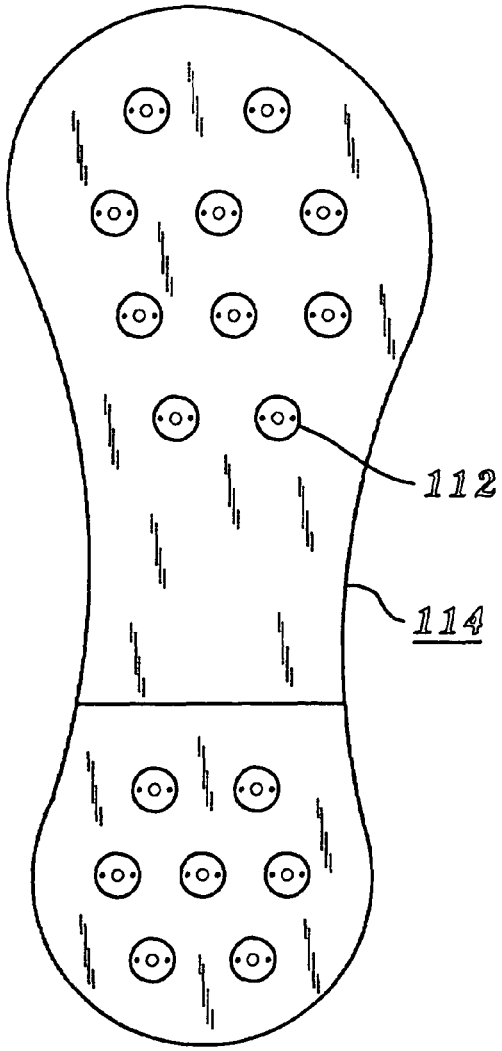
FIG. 12
'Prior Art'
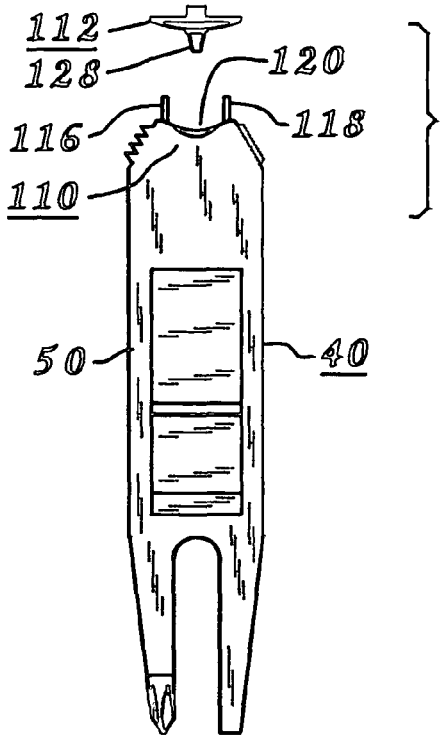
FIG. 14a
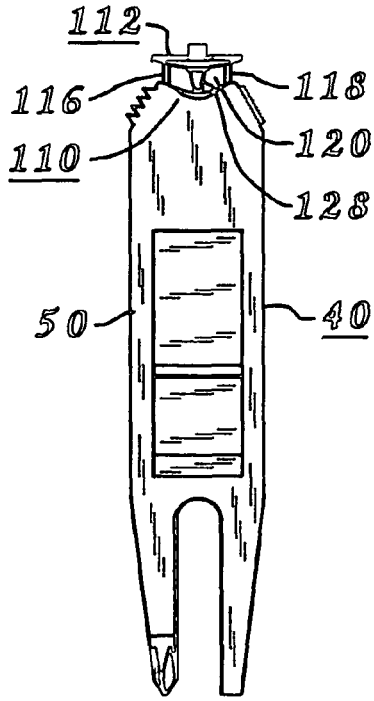
FIG. 14b

GOLF TOOL RETENTION CLIP

CROSS-REFERENCE

This application is a continuation-in-part of Ser. No. 12/157,693 filed Jun. 12, 2008, entitled "Multiple Purpose Golf Tool", currently pending, which was a continuation-in-part of Ser. No. 11/825,810 filed Jul. 9, 2007, entitled "Golf Tool Storage on Putter", now U.S. Pat. No. 7,527,563. The original applications are incorporated herein by this reference.

BACKGROUND

1. Field of the Invention

Generally, the invention relates to retention clips to retain a golf tool for ready access to the golf tool by a player of the game of golf. More specifically, the invention relates to such retention clips which attach to a hat worn by the player of the game of golf.

2. Description of the Prior Art

Numerous methods exist for a player of the game of golf to transport a golf tool during play of the game of golf. Typically the player will simple carry the golf tool about in his or her pocket. This method is not liked by most players due to the need to move freely during swinging of golf clubs. In these occasions the golf tool may rub against the player. It is known to retain the golf tool on clips positioned on the belt of the player. This method is not liked by most players due to the tendency of the golf tool to snag against a shirt worn by the player, particularly during swinging the golf clubs. Various deficiencies exist with the known methods of transporting golf tools during play of the game of golf.

As can be seen various attempts have been made to provide for a player of golf to transport a golf tool during play of the game of golf. These attempts have been less efficient than desired. As such, it may be appreciated that there continues to be a need for a hat attachable retention clip which will securely retain a golf tool yet provide for ready removal and easy of the golf tool and ready and easy replacement of the golf tool while the golf tool is retained in a position where the clip and the golf tool will not interfere in any way with the play of the game of golf. The present invention substantially fulfills these needs.

SUMMARY

In view of the foregoing disadvantages inherent in the known types of methods of transporting a golf tool during play of the game of golf, your applicant has devised a hat attachable retention clip capable of retaining a golf tool. The hat attachable retention clip for attachment to a brim of a hat where the hat attachable retention clip will remain with a wearer of the hat. The brim of the hat having an upper surface and a lower surface. The hat attachable retention clip to releasably retain a golf tool having a useful purpose associated with play of the game of golf. The hat attachable retention clip having attachment means, placement means, retention means and removal means. The attachment means provides for attaching the hat attachable retention clip to the brim of the hat. The hat attachable retention clip contacts the upper surface of the brim of the hat and the lower surface of the brim of the hat subsequent to attachment. The placement means provides for positioning the golf tool on the hat attachable retention clip positioned on the brim of the hat. The retention means provides for retaining the golf tool on the hat attachable retention clip positioned on the brim of the hat. The removal means provides for removing the golf tool from the hat attachable retention clip positioned on the brim of the hat.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a hat attachable retention clip positioned on a brim of a hat during the play of the game of golf to retain a golf tool for ready access of the golf tool by a player wearing the hat.

Other objects include;

a) to provide for the hat attachable retention clip to also retain a ball marker for ready access by the player wearing the hat.

b) to provide for the golf tool to be a multiple purpose golf tool.

c) to provide for the multiple purpose golf tool to be small and compact and of a one piece design without any moving parts where the player will feel comfortable transporting the multiple purpose golf tool around with them during the play of the game of golf.

d) to provide for a multiple purpose golf tool having a divot repair tool incorporated thereon.

e) to provide for the multiple purpose golf tool to optionally have a club support tool incorporated thereon.

f) to provide for the multiple purpose golf tool to optionally have a club face groove cleaner tool incorporated thereon.

g) to provide for the multiple purpose golf tool to optionally have a golf shoe spike cleaner tool incorporated thereon.

h) to provide for the multiple purpose golf tool to optionally have a golf shoe spike install/removal tool incorporated thereon.

i) to provide for the multiple purpose golf tool to optionally have a phillips head screwdriver tool incorporated thereon.

j) to provide for the multiple purpose golf tool to optionally have a slotted head screwdriver tool incorporated thereon.

k) to provide for the multiple purpose golf tool to optionally have a bottle opener tool incorporated thereon.

l) to provide for the multiple purpose golf tool to optionally have a pencil sharpener tool incorporated thereon.

m) to provide for the multiple purpose golf tool to optionally have a beverage can pull tab lifter tool incorporated thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 12 is a plan view of the bottom of a golf shoe and labeled as 'Prior Art'.

FIG. 13 is a plan view of the bottom of a spike member as used on the golf shoe depicted in FIG. 12 and labeled as 'Prior Art'.

FIG. 14*a* and FIG. 14*b* are front elevational views of the multiple purpose golf tool and the spike member shown in FIG. 13 as would occur during a spike member adjustment procedure.

DESCRIPTION

Figures 1A, 1B:
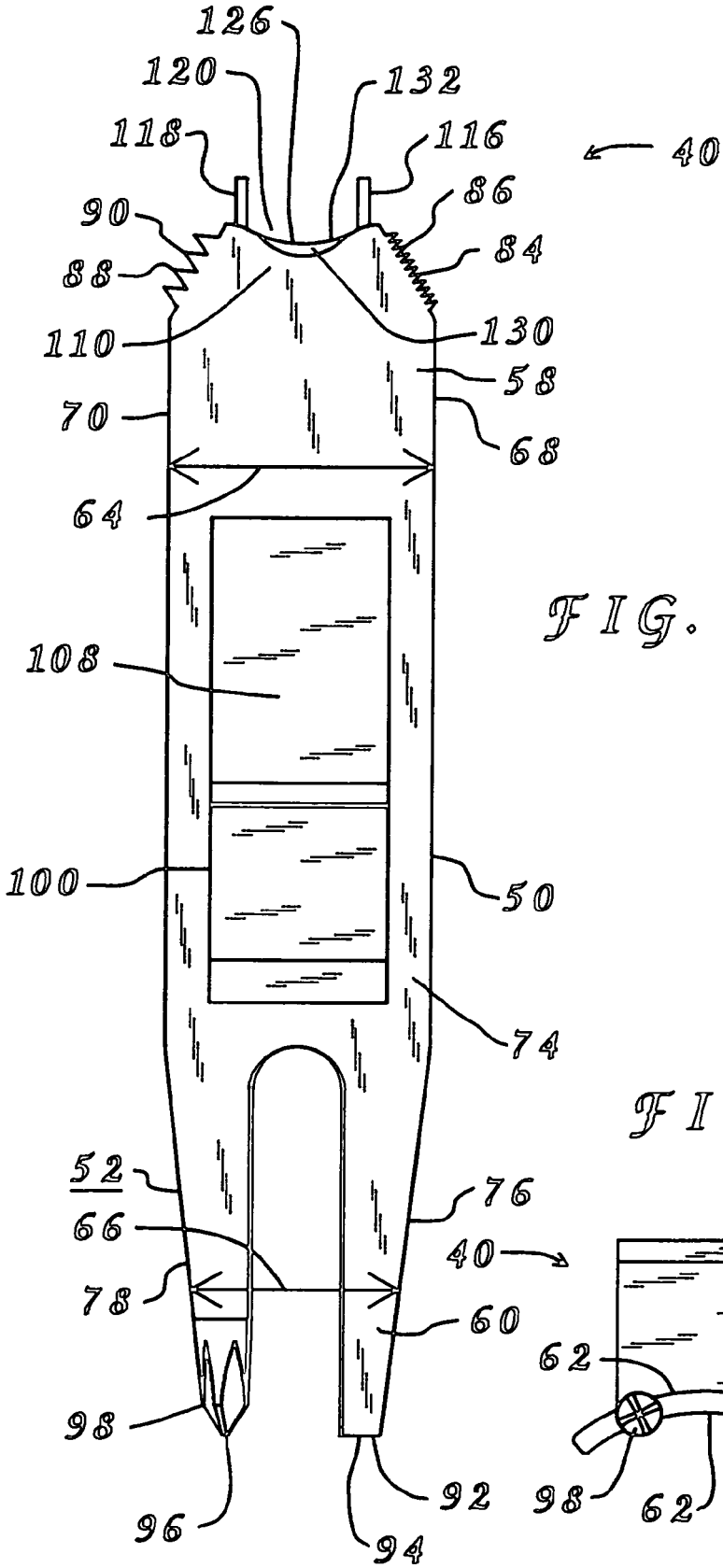
FIG. 1*a* is a front elevational view of a multiple purpose golf tool.
FIG. 1*b* is a bottom plan view of the multiple purpose golf tool.
Figure 1C:
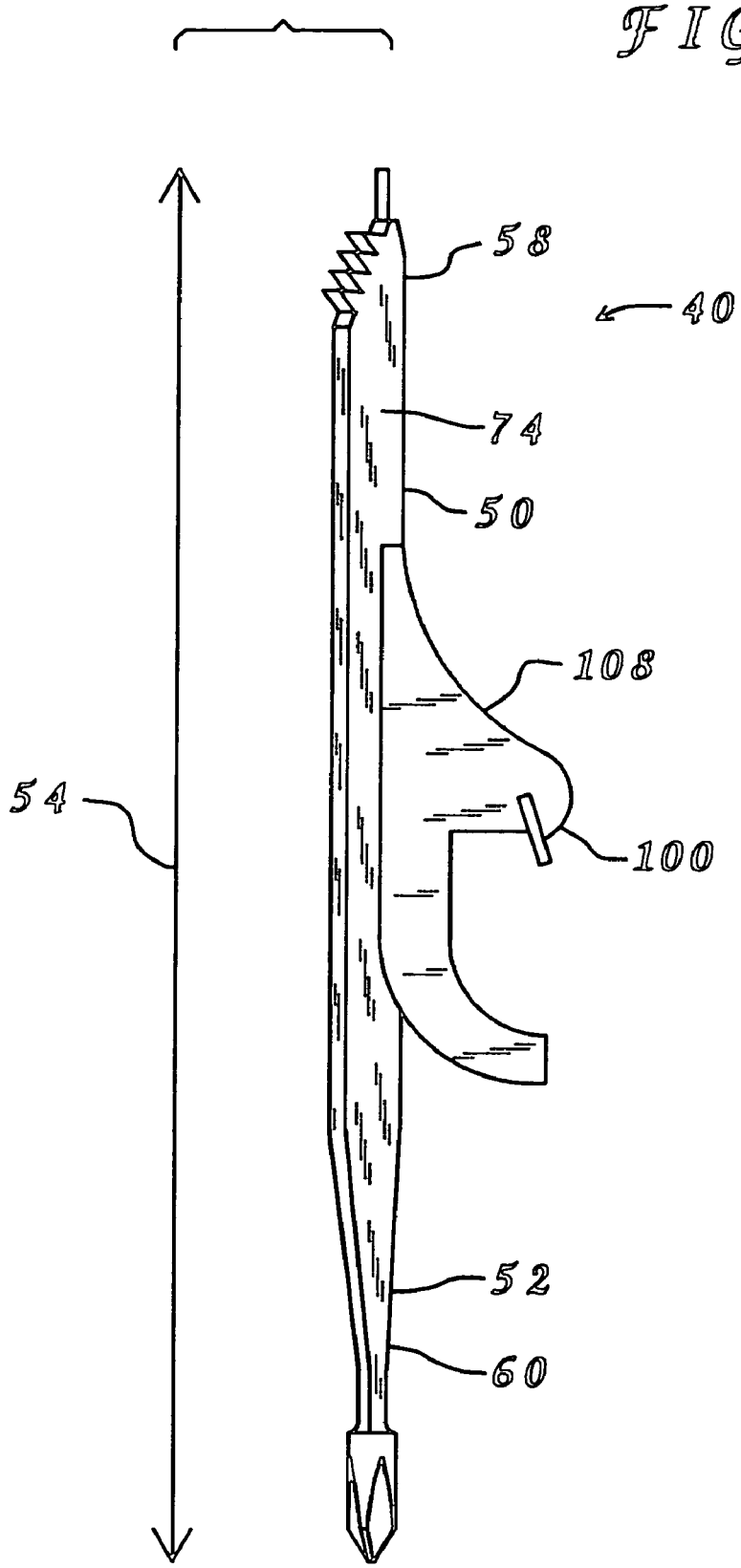
FIG. 1*c* is a side elevational view of the multiple purpose golf tool.
Figure 1E:
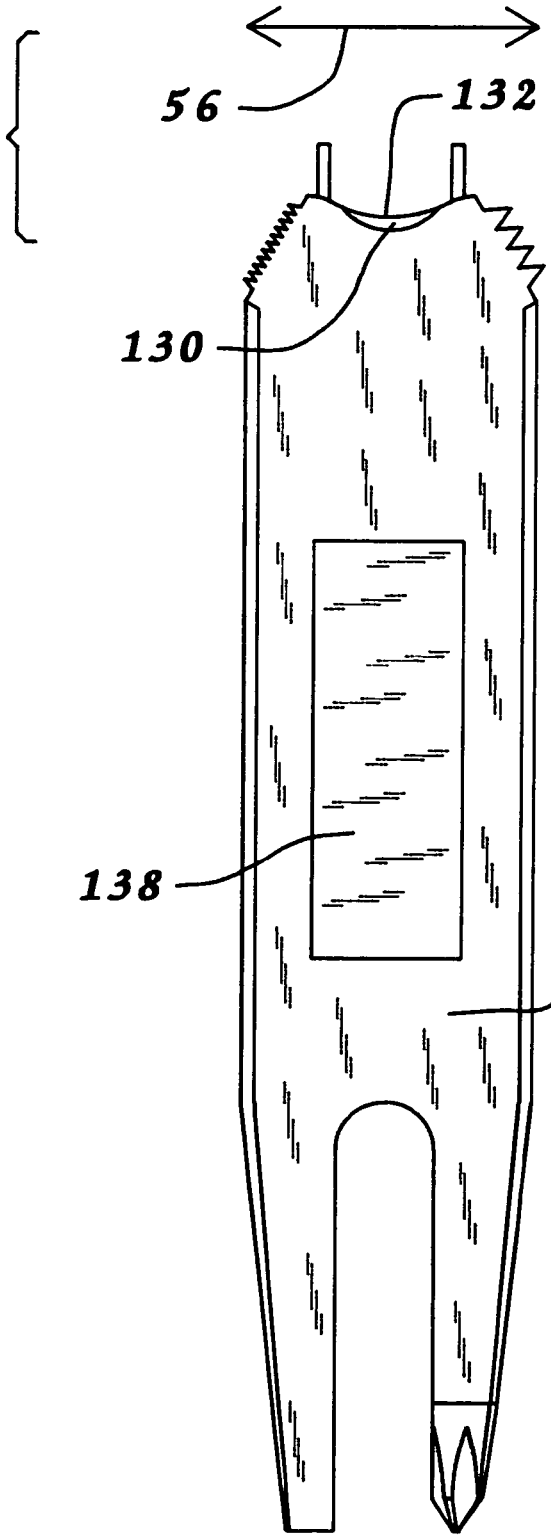
FIG. 1*e* is a top plan view of the multiple purpose golf tool.
Figure 1D:
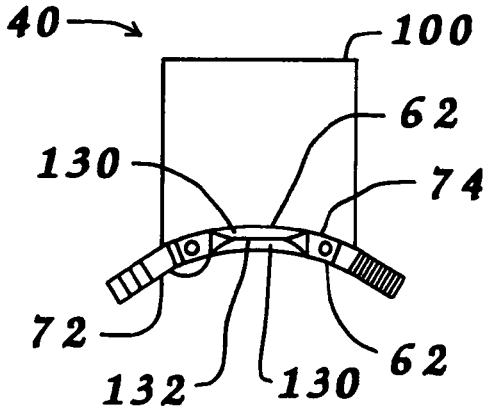
FIG. 1*d* is a rear elevational view of the multiple purpose golf tool.

Many different devices having features of the present invention are possible. The following description describes the preferred embodiment of select features of those devices and various combinations thereof. These features may be deployed in various combinations to arrive at various desired working configurations of devices.

Reference is hereafter made to the drawings where like reference numerals refer to like parts throughout the various views.

Structural configurations will be provided on a multiple purpose golf tool, having features of the present invention, to perform respective useful functions associated with the play of the game of golf.

A hat attachable retention clip 20 retains golf tool 40 while hat attachable retention clip 20 is attached to a brim 42 of a hat 44. This provides for hat attachable retention clip 20 to remain with a wearer, not shown, of hat 44. Brim 42 of hat 44 has an upper surface 46 and a lower surface 48. Hat attachable retention clip 20 releasably retain golf tool 40. Hat attachable retention clip 20 has an upper panel 140, a lower panel 142, a connecting portion 144 and retention means to provide for releasably retain golf tool 40 on hat attachable retention clip 20. Upper panel 140 contacts at least a portion of upper surface 46 of brim 42 when hat attachable retention clip 20 is attached to brim 42 of hat 44. Lower panel 142 contacts at least a portion of lower surface 48 of brim 42 when hat attachable retention clip 20 is attached to brim 42 of hat 44. Connecting portion 144, also known as common wall portion, connects upper panel 140 and lower panel 142 so that upper panel 140 and lower panel 142 are retained relative to each other with a spacing therebetween. Upper panel 140 has a longitudinal axis 146, lower panel 142 has a longitudinal axis 148. Longitudinal axis 146 of upper panel 140 and longitudinal axis 148 of lower panel 142 are generally parallel. Connecting portion 144 has an angular orientation 150 which is significantly offset from longitudinal axis 146 of upper panel 140 and from longitudinal axis 148 of lower panel 142. Upper panel 140 contacts upper surface 46 of brim 42 of hat 44 while lower panel 142 contacts lower surface 48 of brim 42 of hat 44 subsequent to attachment of hat attachable retention clip 20 to brim 42 of hat 44. The spacing between upper panel 140 and lower panel 142 provide for hat attachable retention clip 20 to fit in a snug manner when positioned on brim 42 of hat 44.

A first magnet 152, also known as clip magnet, is attached to hat attachable retention clip 20 and a second magnet 138, also known as tool magnet, is attached to golf tool 40. First magnet 152 and second magnet 138 cooperate while positioned in close proximity to retain golf tool 40 on hat attachable retention clip 20. A base wall 154 and opposing guide walls 156 and 158 act to guide placement of golf tool 40 onto hat attachable retention clip 20. Opposing guide walls 156 and 158 have a relative spacing to each other with the spacing tapering from an insertion end 160 to a retention end 162.

It is desirable to provide the hat attachable retention clip with a curvature along the longitudinal orientation to match a curvature of the brim of the hat to which the hat attachable retention clip is to attached. This provides for the hat to retain a normal look with the same characteristics of the brim in a natural state. When the hat attachable retention clip has a curvature it is desirable to provide for the golf tool to similarly have a curvature along the longitudinal orientation.

A ball marker base wall 164 and opposing ball marker guide walls 166 and 168 cooperate to guide placement of a ball marker 170 during a placement of ball marker 170 on hat attachable retention clip 20. Opposing ball marker guide walls 166 and 168 having a relative spacing to each other with the spacing tapering from an insertion end 172 to a retention end 174. Opposing ball marker guide walls 166 and 168 and ball marker base wall 164 cooperate to guide placement of ball marker 170 during positioning of ball marker 170 on hat attachable retention clip 20. The area from insertion end 172 to retention end 174 define a ball marker placement surface 176 where ball marker 170 will be retained. Ball marker placement surface 176 is planar. Hat attachable retention clip 20 has a ball marker magnet 178 positioned thereon to retain ball marker 170 securely when positioned at a ball marker retention position 176 on hat attachable retention clip 20.

Preferably each multiple purpose golf tool of the present invention will have structural elements to permit repair of divots on the greens where an impact of a golf ball from a lofted shot compresses the soil and the root system of grass in the soil of the turf. Conventional divot tool often have two tines extending from a gripping portion where the user slides the tines into the turf and gently manipulates the tool to lift the root system of the effected grass to release the pressure.

Multiple purpose golf tool 40 is depicted as having numerous optional features positioned thereon to perform numerous useful functions associated with the play of the game of golf. Multiple purpose golf tool 40 has a grip portion 50 and a turf penetration portion 52. Multiple purpose golf tool 40 has a longitudinal orientation 54 and a lateral orientation 56. At opposing ends of longitudinal orientation 54 are an upper end 58 and a lower end 60 with upper end 58 being on grip portion 50. A curvature 62 extends across at least a portion of lateral orientation 56 along at least a substantial portion of grip portion 50. Curvature 60 provides for contouring attachment of multiple purpose golf tool 40 to shaft 24 of golf club 22. Upper end 58 has a lateral width 64 while lower end 60 has a lateral width 66 with lateral width 64 of upper end 58 substantially greater than lateral width 66 of lower end 60. Grip portion 50 has a first lateral edge 68 and a second lateral edge 70. Multiple purpose golf tool 40 has an inner surface 72 which is in closest proximity to shaft 24 of golf club 22 while multiple purpose golf tool 40 is in attachment relative to golf club 22. Opposing inner surface 72 on multiple purpose golf tool 40 is an outer surface 74.

The lines presented in the various views for longitudinal orientation 54, lateral orientation 56, lateral width 64 and lateral width 66 have been included to further explain features of the present invention and the lines form no structural part of the embodiment depicted.

Turf penetration portion 52 of multiple purpose golf tool 40 further comprises opposing tines 76 and 78 which extend away from grip portion 50. Turf penetration portion 52 provides for multiple purpose golf tool 40 to be manually manipulated to insert turf penetration portion 52 into turf 34 of golf course 38 then manually manipulated to release a compression 80 of turf 34 about a point of insertion 82.

Grip portion 50 of multiple purpose golf tool 40 has a series of protrusions 84 having a first configuration measurement 86 positioned on first lateral edge 68 at upper end 58. Grip portion 50 of multiple purpose golf tool 40 further has a series of protrusions 88 having a second configuration measurement 90 positioned on second lateral edge 70 at upper end 58. First configuration measurement 86 is substantially unique from second configuration measurement 90 where series of protrusions 84 on first lateral edge 68 may be used for a first cleaning operation performed on a piece of golf equipment, not shown, and where series of protrusions 88 on second lateral edge 70 may be used for a second cleaning operation performed on another piece of golf equipment, also not shown.

Examples of golf equipment which may have a cleaning operation performed thereon include the face, including trenches or other patterns, of heads of golf clubs which may gather soil and other debris thereon, and the soles of golf shoes, including about spikes positioned thereon. When a lateral curvature is provided on the multiple purpose golf tool the area of the multiple purpose golf tool about the protrusions may be flattened where the tips of each respective set of protrusions are linearly aligned along their entire length for performance of convenient cleaning operations.

Tine 76 has an end 92 having positioned thereon a slotted head screw driving configuration 94 where end 92 of tine 76 may be utilized as a slotted screw driver to manipulate a slotted head screw, not shown, during tightening or loosening of the slotted head screw. Tine 78 has an end 96 having positioned thereon a Phillips head screw driving configuration 98 where end 96 of tine 78 may be utilized as a Phillips screw driver to manipulate a Phillips head screw, not shown, during tightening or loosening of the Phillips head screw.

When a Phillips head screw driving configuration is provided it is possible to plane of the opposing side extending outward relative to the outer surface and the inner surface of the multiple purpose golf tool to reduce the profile of the multiple purpose golf tool while retaining the useful function of the Phillips head screw driving configuration.

When a slotted head screw driving configuration is provided on one tine and a Phillips head screw driving configuration is provided on the opposing tine it is possible to angularly offset these configurations one to the other to provide more clearance to reach the respective fasteners during usage.

Outer surface 74 of multiple purpose golf tool 40 has positioned thereon a bottle opening configuration 100. Bottle opening configuration 100 is capable of engagement of a bottle cap 102 to apply a pivotal pressure to a lip 104 of bottle cap 102 to remove bottle cap 102 from a bottle 106. Bottle opening configuration 100 further has a sloped surface 108 extending smoothly from outer surface 74 of multiple purpose golf tool 40. Sloped surface 108 makes an ideal thumb positioning location for the user during performance of many operations with multiple purpose golf tool 40, including during divot repair operations. It being understood that bottle 106 and bottle cap 102 are workpieces and form no part of the present invention.

Upper end 58 of multiple purpose golf tool 40 has positioned thereon a spike member manipulation configuration 110 to provide for manipulation of a spike member 112 positioned on a golf shoe 114. Spike member manipulation configuration 110 has opposing pins 116 and 118 with a recess 120 positioned between pins 116 and 118. During a tightening or loosening operation performed on spike member 112 pins 116 and 118 penetrate indentations 122 and 124 on spike member 112 while recess 120 accommodates placement of a spike 128 of spike member 112. During such placement multiple purpose golf tool 40 may be manipulated to impart a tightening rotation to spike member 112 or a loosening rotation to spike member 112. It being understood that spike member 112 and golf shoe 114 are workpieces and form no part of the present invention.

Recess 120 is partially defined by an upper protected edge 126 of grip portion 50 of multiple purpose golf tool 40. Upper protected edge 126 is protected against most incidental contact with other objects by pins 116 and 118. Upper protected edge 126 has a taper 130 which results in a sharp edge 132 which may be used for various useful cutting purposes. One example of such a useful cutting purpose involves sharpening a pencil 134 during the play of the game of golf. Due to the spacing between pins 116 and 118 pencil 134 may be easily inserted therebetween and drawn downward along sharp edge 132 to remove material from pencil 134 until a point 136 is to a desired configuration on pencil 134.

Beverage cans have evolved where most such cans currently have a flip type tab which when pivoted upward causes another tab portion to be pushed downward into the can to provide an opening in the can for the contents to pass through. Many designs for the flip type tab have been proposed and are currently in commercial usage. Typically such flip type tabs reside quite close to the top of the can prior to being utilized to open the can. It has been observed that many users have a difficult time with initial displacement of such flip type tabs away from their very close orientation with the top of the can. Often users will attempt to utilize a fingernail to perform the initial displacement operation. It has been known to have damage occur to the fingernail during such operations.

It is known to utilize a structural element, with various prior art references specifically directed toward this single useful function, to perform at least the initial tab displacement operation. Referring now to the present invention one of the tines, most likely the one with the slotted head screw driving configuration thereon, may be utilized to perform this initial displacement operation on flip type tabs on beverage cans. Alternatively, one of the series of protrusions on the lateral edges may be utilized to perform this initial displacement operation on flip type tabs on beverage cans. Alternatively, one, or both, of the pins of the spike member manipulation configuration may be utilized to perform this initial displacement operation on flip type tabs on beverage cans.

The multiple purpose golf tool may have features to permit use as a golf club support tool. This is provides for by partially inserted the multiple purpose golf tool into the ground with a golf club contact portion extending above the ground and any manicured grass growing thereon. The golf club contact portion may then have a portion of the golf club positioned thereon while a distal portion of the golf club contacts the ground. The portion of the golf club making contact with the golf club contact portion of the multiple purpose golf tool preferably will be part of the grip of the golf club while the portion of the golf club making contact with the ground will be the head of the golf club. This arrangement provides for the grip to be kept clean and dry. Many configurations may be deployed on the multiple purpose golf tool to permit a secure gravity biased retention of the grip of the golf club on the multiple purpose golf tool. When the above described spike member manipulation configuration is provided on the multiple purpose golf tool the opposing pins make ideal support members for the grip of the golf club. When this feature is not provided the associated recess may be provided which also makes an ideal support member.

Figures 2A, 2B, 3A, 3B, 4, 5A, 5B, 8:
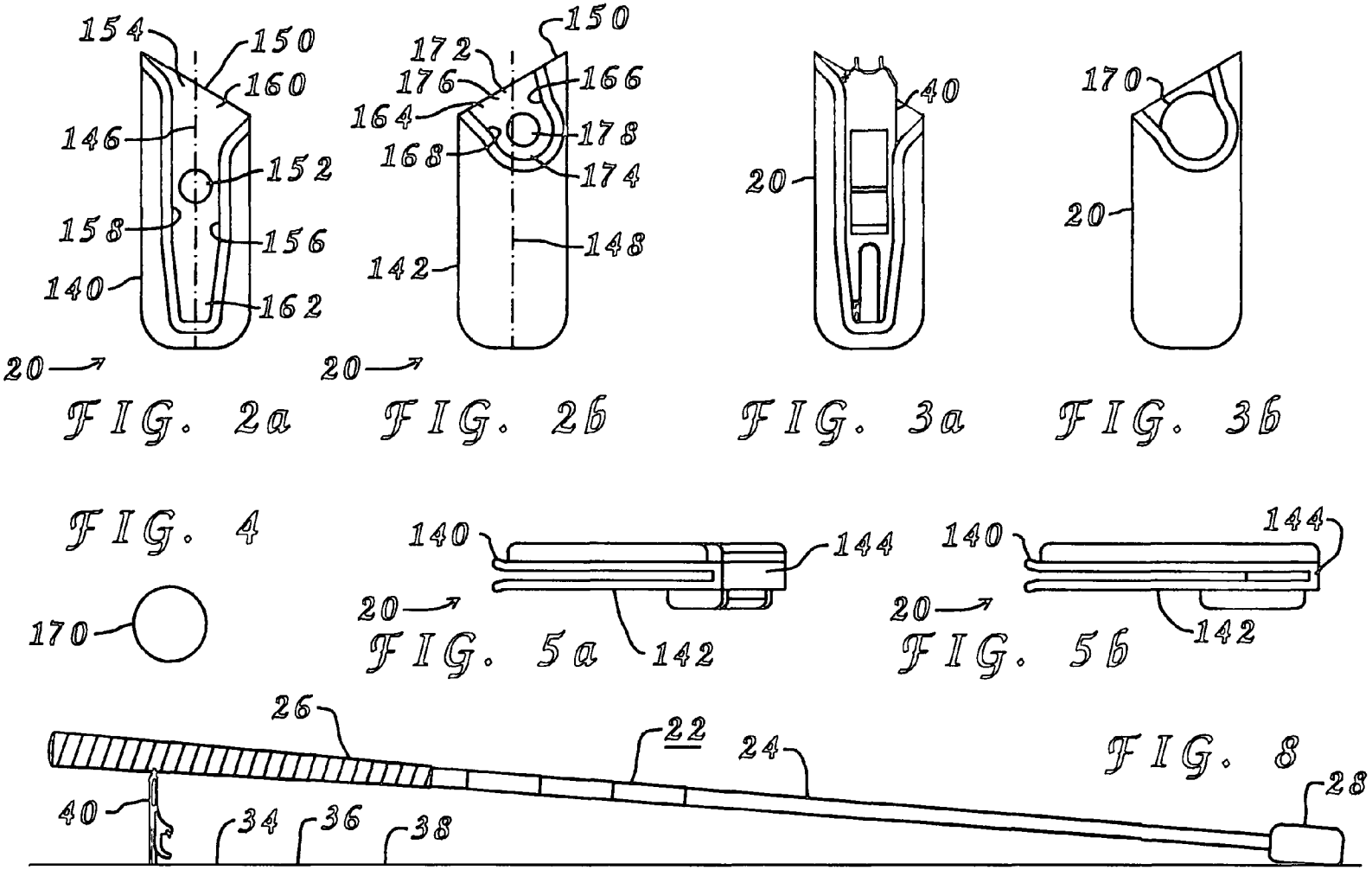
FIG. 2*a* is a top plan view of a hat attachable retention clip.
FIG. 2*b* is a bottom view of the hat attachable retention clip.
FIG. 3*a* is a top plan view of the hat attachable retention clip with the multiple purpose golf tool attached.
FIG. 3*b* is a bottom plan view of the hat attachable retention clip with a ball marker attached.
FIG. 4 is a top plan of a ball marker.
FIG. 5*a* is a side elevation view of the hat attachable retention clip.
FIG. 5*b* is a side elevation view of the hat attachable retention clip.
FIG. 8 is a side elevational view of the multiple purpose golf tool partially supporting the golf club above the turf of a golf course.
Figure 6A:
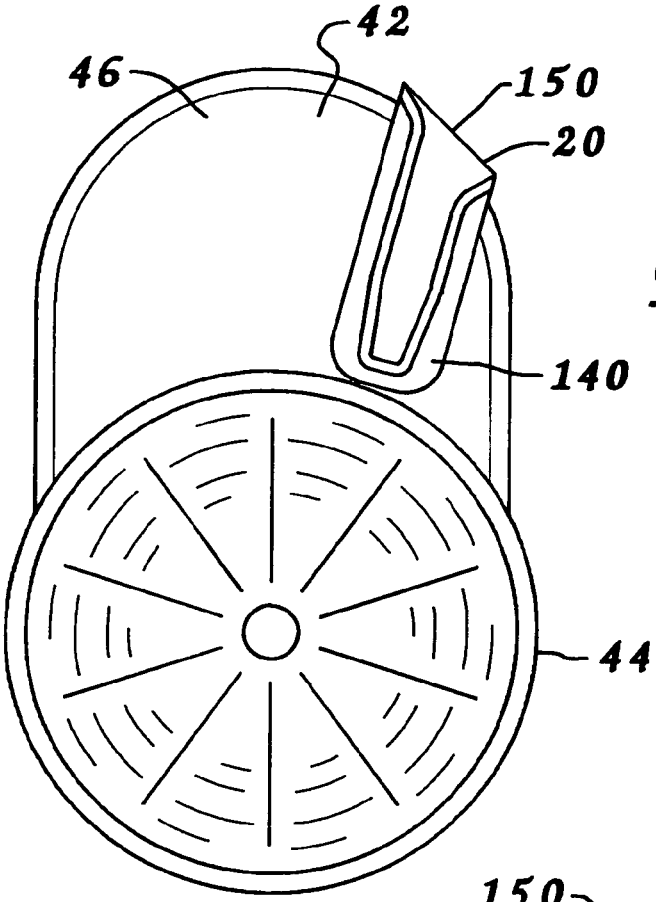
FIG. 6*a* is a top plan view of the hat attachable retention clip positioned on a hat.
Figure 6B:
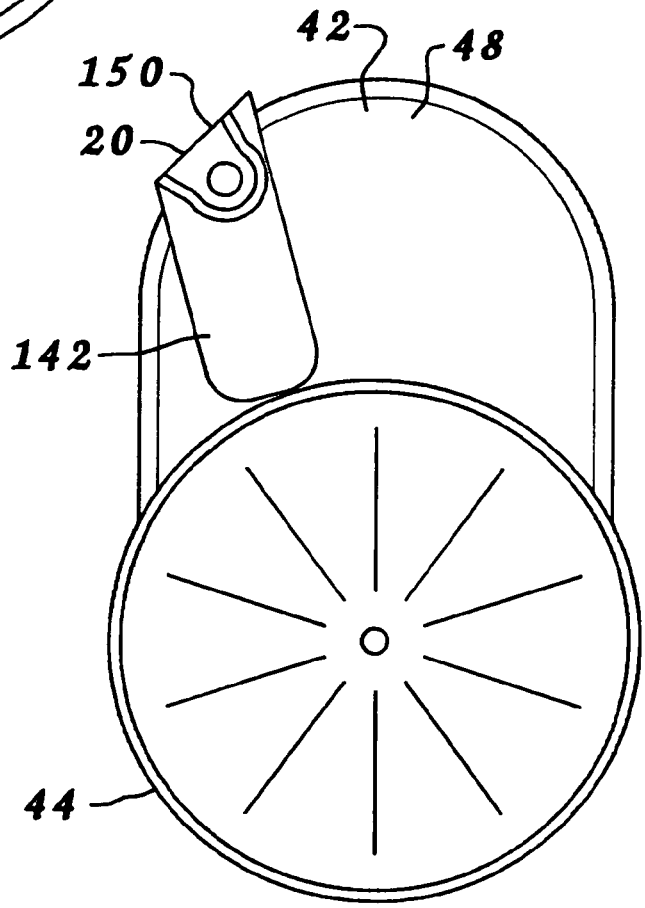
FIG. 6*b* is a bottom plan view of the hat attachable retention clip positioned on a hat.
Figure 7A:
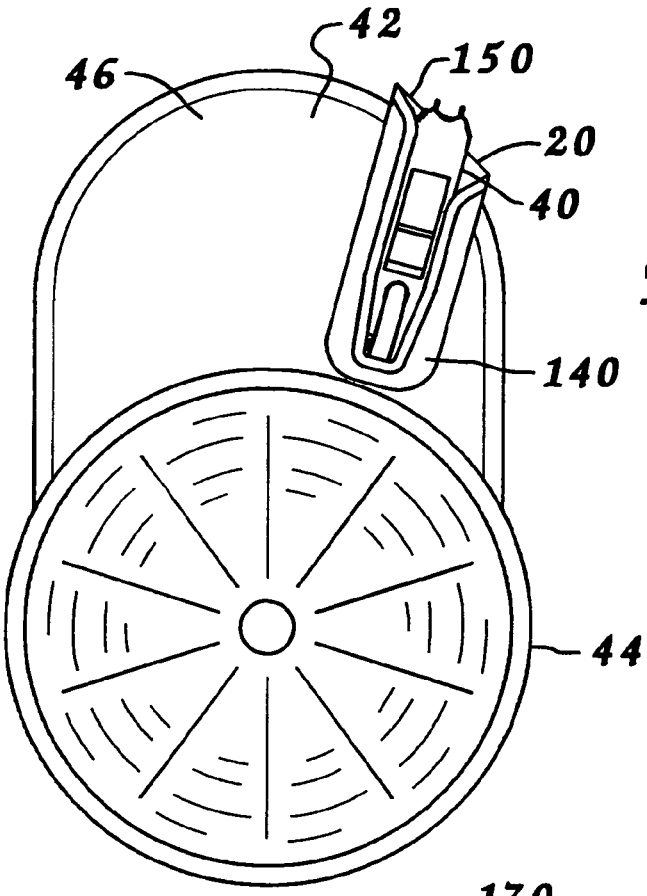
FIG. 7*a* is a top plan view of the hat attachable retention clip attached to the hat with the hat attachable retention clip attached.
Figure 7B:
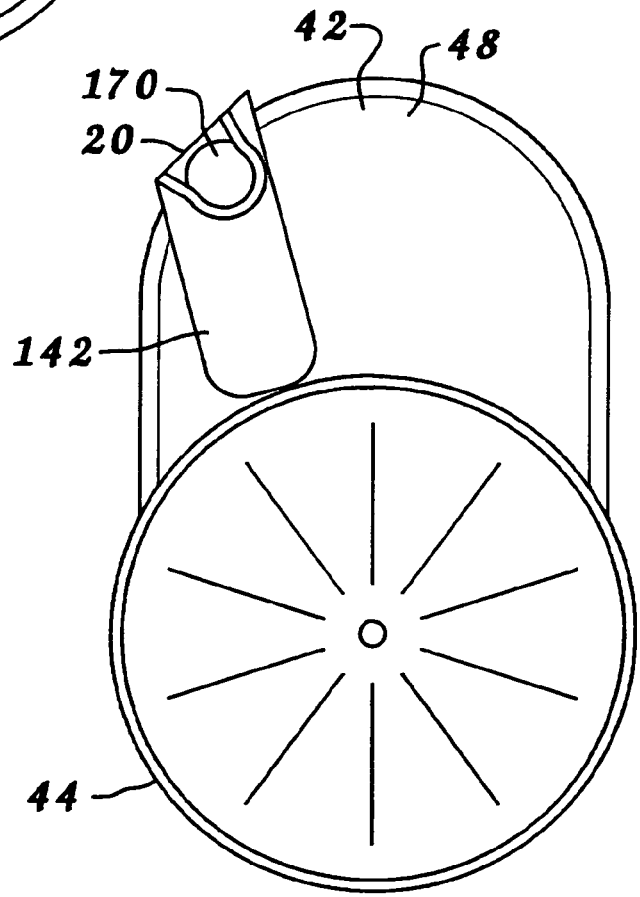
FIG. 7*b* is a bottom plan view of the hat attachable retention clip attached to the hat with the ball marker attached.
Figure 9A:
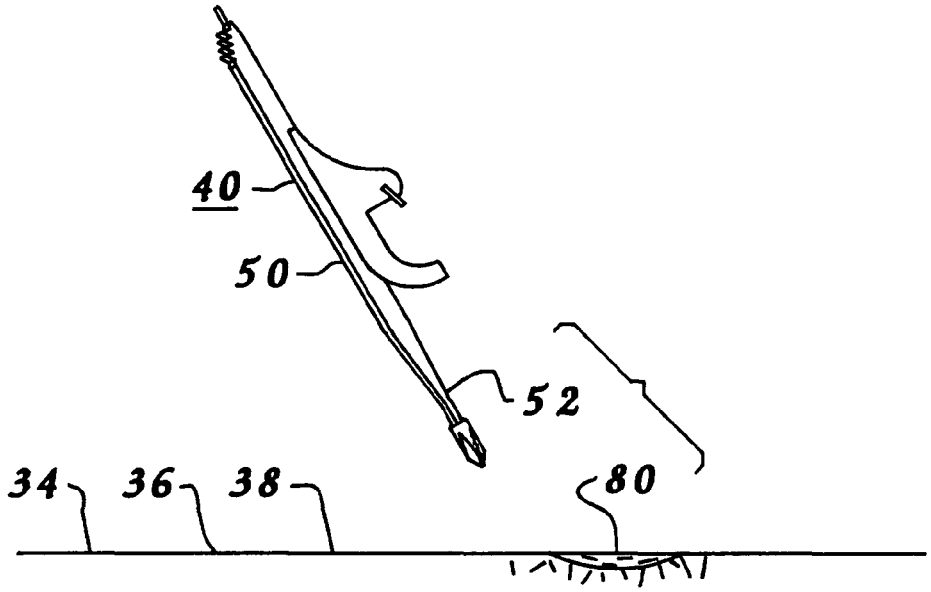
FIG. 9*a* through FIG. 9*c* are side elevational views of the multiple purpose golf tool performing a divot repair procedure.
Figure 9B:
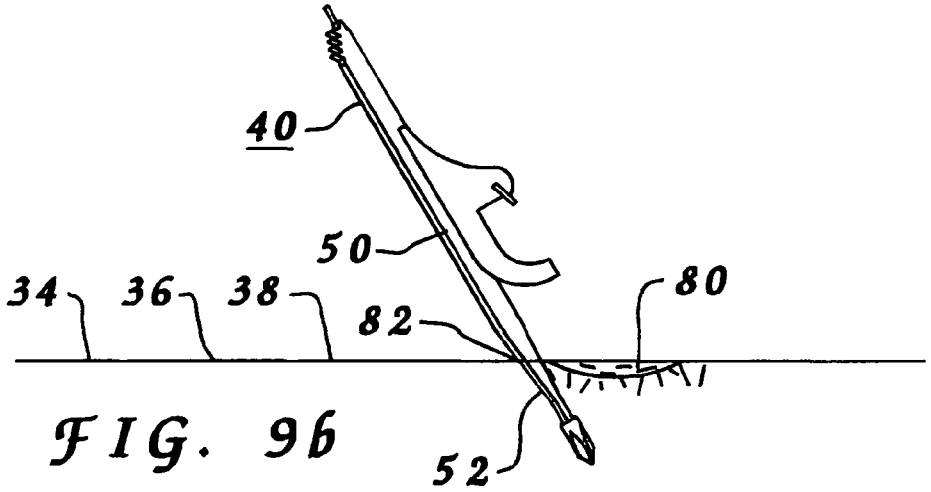
Figure 9C:
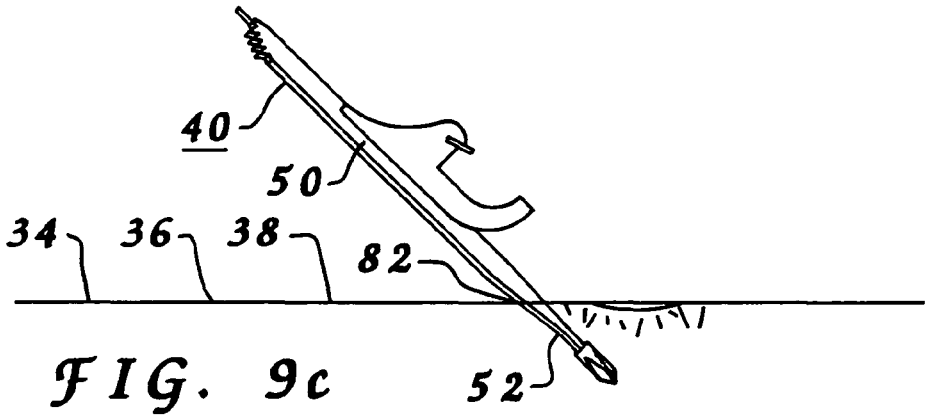
Figure 10A:
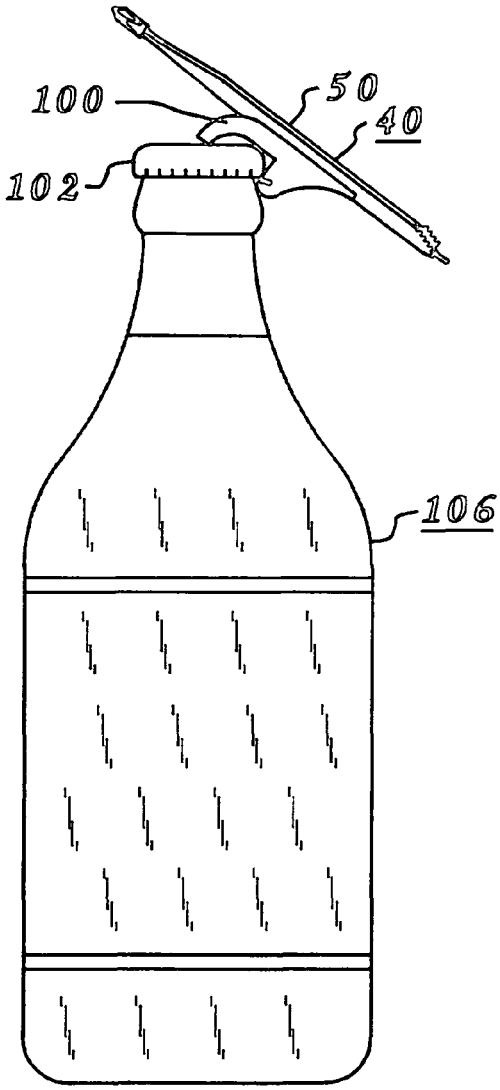
FIG. 10*a* and FIG. 10*b* are side elevational views of the multiple purpose golf tool performing a bottle opening procedure.
Figure 10B:
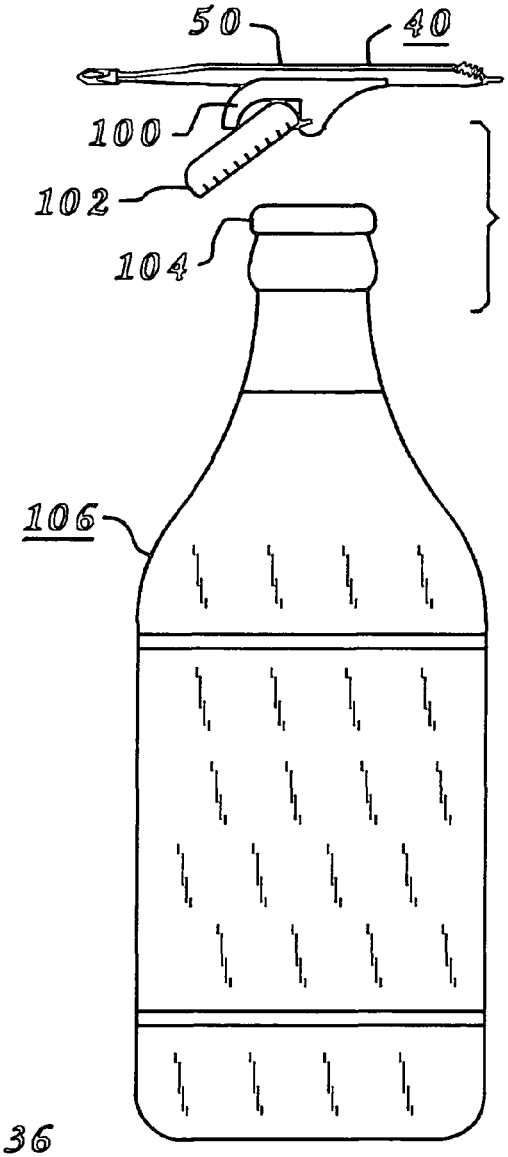
Figure 11:
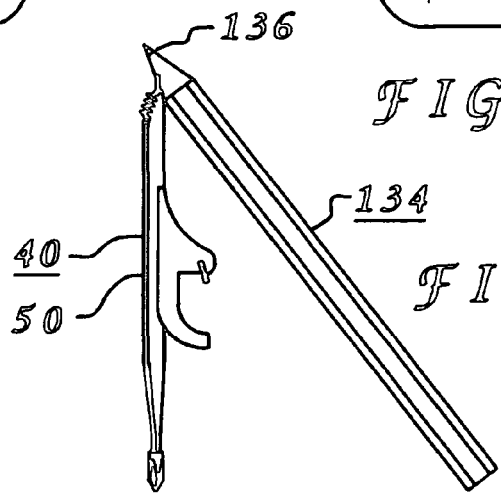
FIG. 11 is a side elevational view of the multiple purpose golf tool performing a pencil sharpening procedure.

FIG. 8 depicts multiple purpose golf tool 40 partially inserted in turf 34 and functioning as a golf club support tool where pins 116 and 118 contact and support grip 26 of golf club 22 above turf 34 while head 28 of golf club 22 rests on turf 34.

Figure 18:
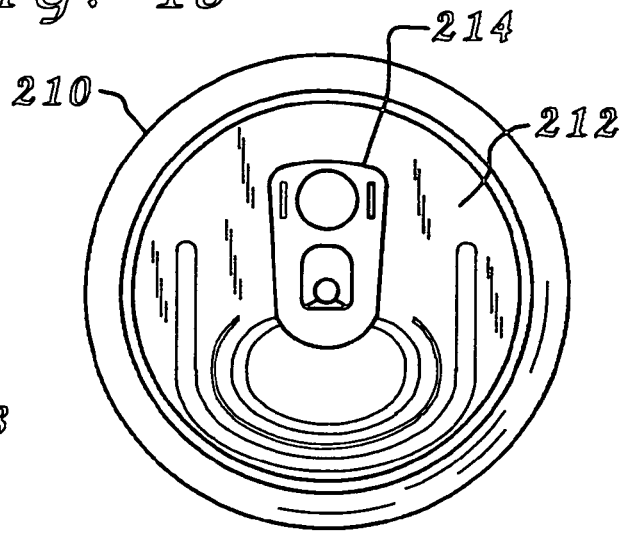
FIG. 18 is a top plan view of a top of a beverage can with a pull tab.
Figure 15:
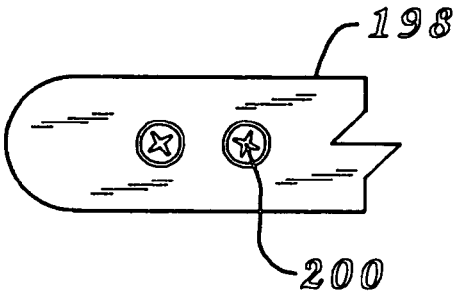
FIG. 15 is a plan view of a piece of golf equipment having a Phillip head screw.
Figure 16:
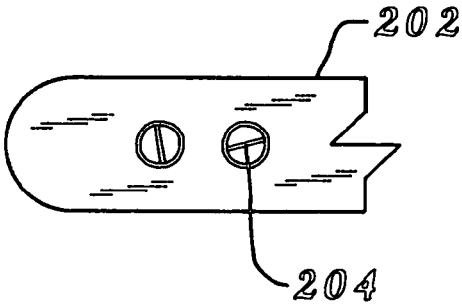
FIG. 16 is a plan view of a piece of golf equipment having a slotted head screw.
Figure 17:
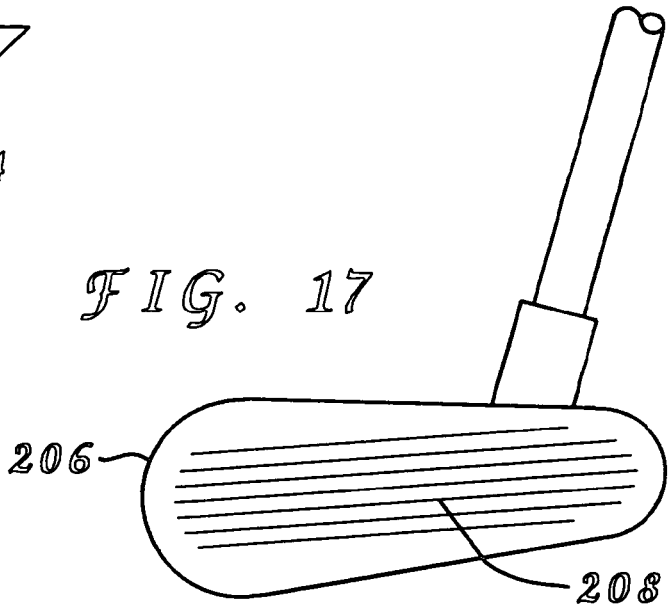
FIG. 17 is a front elevational view of a face of a golf club.

FIG. 15 depicts a piece of golf equipment 198 having a Phillips head screw 200 upon which Phillips head screw driving configuration 98, see FIG. 1, may operate. FIG. 16 depicts a piece of golf equipment 202 having a slotted head screw 204 upon which slotted head screw driving configuration 94, see FIG. 1, may operate. FIG. 17 depicts a golf club head 206 having grooves 208 thereacross. Depending upon the configuration of grooves 208 series of protrusions 84 or series of protrusions 88, see FIG. 1, may be utilized to remove material therefrom during a cleaning operation. FIG. 18 depicts a lid 210 of a beverage can 212 having a pull tab 214. End of tine 76, see FIG. 1, may be used to pry pull tab 214 away from lid 210 during an opening procedure of beverage can 212.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An assembly for use with a hat to be worn by a wearer, the hat having a brim, the brim of the hat having an upper surface and a lower surface, the assembly comprising:

a) a multiple purpose golf tool having a plurality of useful purposes associated with play of the game of golf and wherein the multiple purpose golf tool further comprises a tool magnet;

b) a hat attachable retention clip for attachment to a brim of a hat where the hat attachable retention clip will remain with the wearer of the hat, the hat attachable retention clip to releasably retain the multiple purpose golf tool, the hat attachable retention clip having:

i) an upper panel to contact at least a portion of the upper surface of the hat when the hat attachable retention clip is attached to the brim of the hat;

ii) a lower panel to contact at least a portion of the lower surface of the hat when the hat attachable retention clip is attached to the brim of the hat;

iii) a connecting portion connecting the upper panel and the lower panel wherein the upper panel and the lower panel are retained relative to each other with a spacing therebetween;

iv) a base wall;

v) opposing guide walls positioned on opposing sides of the base wall and wherein the opposing guide walls have a relative spacing to each other and wherein a tapering of the spacing of the opposing guide walls exists from an insertion end to a retention end wherein the opposing guide walls and the base wall cooperate to guide placement of the multiple purpose golf tool during a positioning of the multiple purpose golf tool on the hat attachable retention clip;

vi) retention means to provide for releasably retaining the multiple purpose golf tool on the hat attachable retention clip and wherein the retention means of the hat attachable retention clip further comprises a clip magnet and wherein the tool magnet and the clip magnet cooperate while positioned in close proximity to retain the multiple purpose golf tool on the hat attachable retention clip.

2. The assembly defined in claim 1 wherein the hat attachable retention clip contacts the brim of the hat in a snug manner.

3. The assembly defined in claim 1 wherein the upper panel has a longitudinal axis and wherein the lower panel has a longitudinal axis and wherein the longitudinal axis of the upper panel and the longitudinal axis of the lower panel are generally parallel and wherein the connecting portion has an angular orientation which is significantly offset from the longitudinal axis of the upper panel and the longitudinal axis of the lower panel.

4. The assembly defined in claim 1 wherein the hat attachable retention clip further comprises ball marker retention means to provide for retention of a ball marker on the hat attachable retention clip.

5. An assembly for use with a hat to be worn by a wearer, the hat having a brim, the brim of the hat having an upper surface and a lower surface, the assembly comprising:

a) a multiple purpose golf tool having a plurality of useful purposes associated with play of the game of golf, the multiple purpose golf tool further comprises:

i) a turf penetration portion to perform a first useful function associated with the play of the game of golf, the first useful function being release of compression of turf associated with an impact from a golf ball, the turf penetration portion having a first extension and a second extension, the turf penetration portion for insertion into the turf at a point of insertion and then manual manipulation of the multiple purpose golf tool to displace the turf penetration portion while inserted in the turf to release the compression of the turf about the point of insertion of the turf penetration portion;

ii) a structural configuration to perform a second useful function associated with the play of the game of golf and positioned on at a distal end of the first extension of the turf penetration portion, the second useful function being applying a rotational pressure to a slot of a slotted head screw utilizing a slotted head screwdriver configuration at the distal end of the first extension of the turf penetration portion;

iii) a structural configuration to perform a third useful function associated with the play of the game of golf and positioned on at a distal end of the second extension of the turf penetration portion, the third useful function being applying a rotational pressure to a phillips slot of a phillips slotted head screw utilizing a phillips slotted head screwdriver configuration at the distal end of the second extension of the turf penetration portion;

iv) structural configuration to perform a fourth useful function associated with the play of the game of golf;

b) a hat attachable retention clip for attachment to a brim of a hat where the hat attachable retention clip will remain with the wearer of the hat, the hat attachable retention clip to releasably retain the multiple purpose golf tool, the hat attachable retention clip having:

i) an upper panel to contact at least a portion of the upper surface of the hat when the hat attachable retention clip is attached to the brim of the hat;

ii) a lower panel to contact at least a portion of the lower surface of the hat when the hat attachable retention clip is attached to the brim of the hat;

iii) a connecting portion connecting the upper panel and the lower panel wherein the upper panel and the lower panel are retained relative to each other with a spacing therebetween;

iv) retention means to provide for releasably retaining the multiple purpose golf tool on the hat attachable retention clip.

6. The assembly defined in claim 5 wherein the hat attachable retention clip contacts the brim of the hat in a snug manner.

7. The assembly defined in claim 5 wherein the upper panel has a longitudinal axis and wherein the lower panel has a longitudinal axis and wherein the longitudinal axis of the upper panel and the longitudinal axis of the lower panel are generally parallel and wherein the connecting portion has an angular orientation which is significantly offset from the longitudinal axis of the upper panel and the longitudinal axis of the lower panel.

8. The golf tool retention clip defined in claim 5 wherein the multiple purpose golf tool further comprises a tool magnet and wherein the retention means of the hat attachable retention clip further comprises a clip magnet and wherein the tool magnet and the clip magnet cooperate while positioned in close proximity to retain the multiple purpose golf tool on the hat attachable retention clip.

9. The assembly defined in claim 5 wherein the retention means of the hat attachable retention clip further comprises opposing a base wall and opposing guide walls positioned on opposing sides of the base wall and wherein the opposing guide walls have a relative spacing to each other and wherein a tapering of the spacing of the opposing guide walls exists from an insertion end to a retention end wherein the opposing guide walls and the base wall cooperate to guide placement of the multiple purpose golf tool into a retention area.

10. The assembly defined in claim 5 wherein the hat attachable retention clip further comprises ball marker retention means to provide for retention of a ball marker on the hat attachable retention clip.

11. An assembly for use with a hat to be worn by a wearer, the hat having a brim, the brim of the hat having an upper surface and a lower surface, the assembly comprising:

a) a multiple purpose golf tool having a plurality of useful purposes associated with play of the game of golf, the multiple purpose golf tool further comprises:

i) a turf penetration portion to perform a first useful function associated with the play of the game of golf, the first useful function being release of compression of turf associated with an impact from a golf ball, the turf penetration portion for insertion into the turf at a point of insertion and then manual manipulation of the multiple purpose golf tool to displace the turf penetration portion while inserted in the turf to release the compression of the turf about the point of insertion of the turf penetration portion and wherein the turf penetration portion further comprises a first extension and a second extension;

ii) a club support arrangement to perform a second useful function associated with the play of the game of golf, the club support arrangement positioned distal on the multiple purpose golf tool from the turf repair tool, the club support arrangement having a first club contact portion and a second club contact portion, the first club contact portion and the second club contact portion to contact a golf club spaced from a head of the golf club while the turf penetration portion of the multiple purpose golf tool is inserted into ground wherein a grip of the club is supported above the ground, the second useful purpose being supporting at least the grip of the club about the ground;

iii) structural configuration to perform a third useful function associated with the play of the game of golf and wherein the structural configuration to perform the third useful function associated with the play of the game of golf and positioned on at a distal end of the first extension of the turf penetration portion, the third useful function being applying a rotational pressure to a slot of a slotted head screw utilizing a slotted head screwdriver configuration at the distal end of the first extension of the turf penetration portion;

iv) structural configuration to perform a fourth useful function associated with the play of the game of golf and wherein the structural configuration to perform the fourth useful function associated with the play of the game of golf and positioned on at a distal end of the second extension of the turf penetration portion, the fourth useful function being applying a rotational pressure to a phillips slot of a phillips slotted head screw utilizing a phillips slotted head screwdriver configuration at the distal end of the second extension of the turf penetration portion;

b) a hat attachable retention clip for attachment to a brim of a hat where the hat attachable retention clip will remain with the wearer of the hat, the hat attachable retention clip to releasably retain the multiple purpose golf tool, the hat attachable retention clip having:

i) an upper panel to contact at least a portion of the upper surface of the hat when the hat attachable retention clip is attached to the brim of the hat;

ii) a lower panel to contact at least a portion of the lower surface of the hat when the hat attachable retention clip is attached to the brim of the hat;

iii) a connecting portion connecting the upper panel and the lower panel wherein the upper panel and the lower panel are retained relative to each other with a spacing therebetween;

iv) retention means to provide for releasably retaining the multiple purpose golf tool on the hat attachable retention clip.

12. The assembly defined in claim 11 wherein the hat attachable retention clip contacts the brim of the hat in a snug manner.

13. The assembly defined in claim 11 wherein the upper panel has a longitudinal axis and wherein the lower panel has a longitudinal axis and wherein the longitudinal axis of the upper panel and the longitudinal axis of the lower panel are generally parallel and wherein the connecting portion has an angular orientation which is significantly offset from the longitudinal axis of the upper panel and the longitudinal axis of the lower panel.

14. The golf tool retention clip defined in claim 11 wherein the multiple purpose golf tool further comprises a tool magnet and wherein the retention means of the hat attachable retention clip further comprises a clip magnet and wherein the tool magnet and the clip magnet cooperate while positioned in close proximity to retain the multiple purpose golf tool on the hat attachable retention clip.

15. The assembly defined in claim 11 wherein the retention means of the hat attachable retention clip further comprises opposing a base wall and opposing guide walls positioned on opposing sides of the base wall and wherein the opposing guide walls have a relative spacing to each other and wherein a tapering of the spacing of the opposing guide walls exists from an insertion end to a retention end wherein the opposing guide walls and the base wall cooperate to guide placement of the multiple purpose golf tool into a retention area.

16. The assembly defined in claim 11 wherein the hat attachable retention clip further comprises ball marker retention means to provide for retention of a ball marker on the hat attachable retention clip.

* * * * *